United States Patent [19]

Roy

[11] Patent Number: 4,789,065

[45] Date of Patent: Dec. 6, 1988

[54] COMBINATION CONTAINER AND PRESS FOR FLEXIBLE SHEETING

[76] Inventor: Ray Roy, 120 Chester St., Lawrence, Mass. 01843

[21] Appl. No.: 46,240

[22] Filed: May 4, 1987

[51] Int. Cl.[4] ..... B65D 1/34; B65D 6/04

[52] U.S. Cl. ..... 206/555; 206/556; 206/449

[58] Field of Search ..... 206/556, 449, 555

[56] References Cited

U.S. PATENT DOCUMENTS

| | | | |
|---|---|---|---|
| 929,016 | 7/1909 | Rensch | 206/449 |
| 2,462,789 | 2/1949 | Trollen | 206/449 |
| 2,666,645 | 1/1954 | Phillips | 206/449 |
| 2,858,016 | 10/1958 | Marano | 206/449 |
| 2,973,868 | 3/1961 | Poskin | 206/449 |
| 3,091,330 | 5/1963 | Roks | 206/449 |
| 3,612,337 | 10/1971 | Harger | 206/449 |
| 4,322,001 | 10/1980 | Hurley | 206/449 |
| 4,580,695 | 4/1986 | Lum | 206/556 |
| 4,602,518 | 5/1987 | Chiappetta et al. | 206/449 |

*Primary Examiner*—Joseph Man-Fu Moy

*Attorney, Agent, or Firm*—Weingarten, Schurgin, Gagnebin & Hayes

[57] ABSTRACT

The invention discloses a box-like container open on one side thereof. A removable wall is slidably received through the open face of the box-like container, the wall being smaller than the open face, and having extending tongues on each of the ends that are larger than the open face. Slots are provided in the walls of the box confronting the tongues, and the wall is retained in the box by engaging the tongues in corresponding openings.

9 Claims, 1 Drawing Sheet

COMBINATION CONTAINER AND PRESS FOR FLEXIBLE SHEETING

BACKGROUND OF THE INVENTION

The present invention is directed to the field of receptacles, and more particularly, to a novel combination container and press for flexible sheeting.

BACKGROUND OF THE INVENTION

In a great many situations, there exists the need to store plural sheets of a flexible material in such a way that the flexible material does not roll up upon itself and thereby depart from its sheet-like condition. The need is specially acute in the case of sheets of sandpaper, where as will readily be appreciated, unattended and uncontained paper tends to curl about itself in such a way as to render it almost worthless from a practical point of view. Various attempts have been made to provide containers for flexible sheets, but have been unacceptable due to expense, comparative complexity, cumbersomeness, relative difficulty of use, and/or short-term and long-term ineffectiveness.

SUMMARY OF THE INVENTION

The present invention contemplates as its principal object a combination container and press for flexible sheeting that is able to receive and retain plural sheets of flexible material, such as sandpaper, in such a way that the contained sheets are pressed flat thereby preventing their undesireable roll-up. In accordance with the present invention a box having side walls and an interconnecting bottom wall defining an open top is disclosed. A generally planar cover dimensioned such that its principal extension is less than the dimension defined by the open top of the box is thereby able to be fit into the open top. Confronting and spaced apart side walls of the open box have slots thereinthrough at different levels along the walls. Minor extending portions projecting in diametrically opposed relation from the ends of the principal surface of the cover are cooperative with the slots to removably retain the cover to the open top box thereby both containing flexible sheet material between the bottom wall and the cover as well as exerting a pressure thereagainst which prevents undesireable rolling upon itself. The cover is fit into any selected slot pair by inserting one of the projections into and through the slot a distance beyond the wall selected to allow the diametrically opposed projection to fit into the open top as it pivots downwardly about the slidably inserted projection. The cover is then slidably moved in the opposite direction to the direction of insertion of the diametrically opposed projection through and into the other slot of the particular slot pair selected. The projections abut the walls of the slots which prevents movement of the cover out of the box. The cover is removed simply by reversing the process. The combination press and container of the present invention is highly efficient in use and is capable of being manufactured at a quite economical cost.

BRIEF DESCRIPTION OF THE DRAWINGS

These and other objects, aspects, and advantages of the present invention may appear from the solely exemplary disclosure of the invention, and from the drawings, wherein.

DETAILED DESCRIPTION OF THE PREFERRED EMBODIMENT

Figure 1:
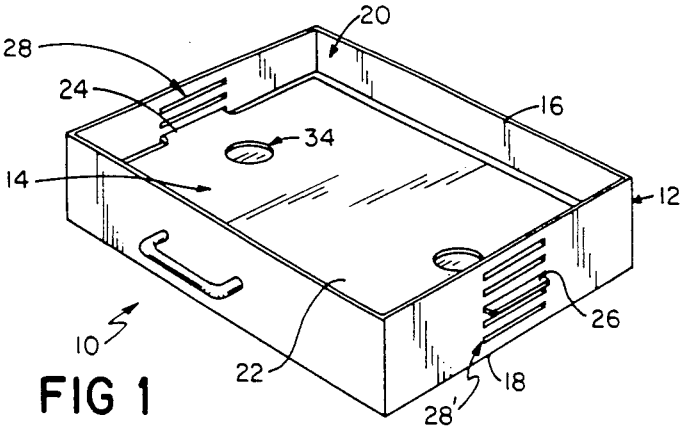
FIG. 1 is a perspective view illustrating the novel combination container/press for sheet materials according to the present invention.

Referring now to FIG. 1, generally designated at 10 is a perspective view illustrating the novel combination container/press for flexible sheet material according to the present invention. The device 10 includes a base generally designated 12 and a cooperative cover generally designated 14. The base 12 preferably includes four upstanding side walls 16 and an included bottom wall 18 defining thereby an open top generally designated 20. The cover 14 is a generally rectangular sheet 20 everywhere dimensioned to be smaller than the dimension defined by the open top 20 except for two tongues 24, 26 that extend in diametrically opposed directions on opposite edges of the cover sheet 22. The span defined by the extending tongues is larger than the corresponding dimension defined between the confronting side walls of the open topped box 12.

Opposing slot pairs generally designated 28, 28' are provided in spaced-apart relation through confronting side walls 16 of the open topped box 12 in position to and so dimensioned as to be able to receive corresponding ones of the extending tongues.

Figure 2:
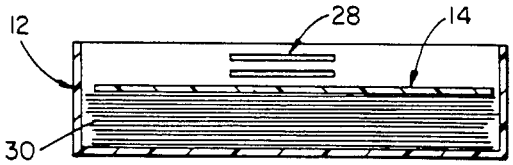
FIG. 2 is a sectional view through the device of FIG. 1 illustrating the pressing retention of sheet material therewithin.

As seen in FIG. 2, the region enclosed by the upstanding walls and included bottom of the open topped box is dimensioned to receive plural sheets of flexible material 30, such as sheets of sandpaper. As will be appreciated, the paper 30 begins to curl if left unattended and to itself. The top 14 is inserted into the open top for containing the paper as well as pressing it downwardly to maintain it in its flat condition.

Figure 3A:
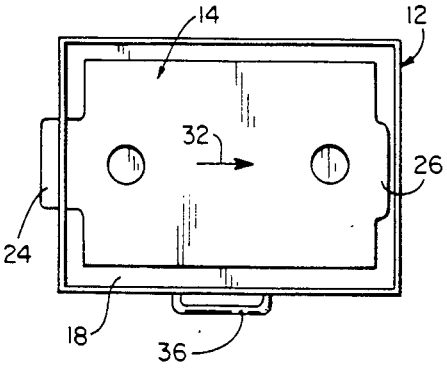
FIG. 3 illustrates in FIG. 3-A and FIG. 3-B thereof plan views useful in explaining the manner by which the cover is removably retained in the device.
Figure 3B:
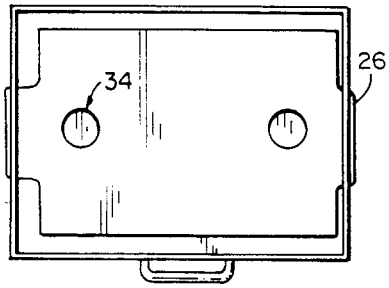

Referring now to FIG. 3-A, the cover 14 is inserted into the open topped box 12 by sliding the tongue 24 into and through a selected one of the slots 28, 28' in the corresponding side wall 16 until the tongue 24 extends through the wall 16 a distance sufficient to clear the tongue 26 from interferring relation with the confronting surface of the opposing side wall 16. As the tongue 26 clears the side wall, the cover 14 pivots downwardly about a line axis and falls into contact with the surface of the stack of sheet material captured between the cover 14 and the bottom wall 18 of the container.

The cover 14 is removably locked in place by sliding it in the direction of an arrow 32 whereby the tongue 36 is inserted into and through the confronting slot of the slot pair corresponding to the particular height of the contained sandpaper.

The tongues 24, 26 abut the walls defining the slots into which they are received, which prevents the movement of the cover in a direction defined normal to its plane. The natural outward spring-like pressure exerted by the contained sheet material produces a sufficient outward pressure to frictionally lock up against the cover preventing its movement laterally, so that the tongues 24, 26 are therewith releasably retained in the slots against unintended slippage of the cover.

Openings generally designated 34 are provided through the cover 14 which provide an edge for receiving an instrument, such as a screwdriver or for receiving a human appendage such as the thumb of the user for facilitating the intended movement of the cover into and out of corresponding ones of the slots provided therefor in the side walls.

The cover includes a handle 36 secured to one of the side walls of the open-topped box by any suitable means such as by threaded fasteners. The handle 36 is gripped by the hand, the contained and pressed flexible sheet material is upended, and the combination container/-press of the invention is easily portable whereby the enclosed sandpaper can be readily moved in the field and on site.

Many modifications of the presently disclosed invention will become apparent to those skilled in the art without departing from the inventive concept.

What is claimed is:

1. A combination container/press for flexible sheet materials that tend to roll-up upon themselves if left unattended, comprising:

a container member having at least two spaced-apart confronting side walls and an included bottom wall defining an open top having a preselected dimension, said side walls having plural pairs of confronting slots being provided on each of the confronting side walls, the side walls extending along a direction defined from the bottom wall to the open top, the plural pairs of confronting slots being in spaced-apart relation on said side walls along said dimension defined from the bottom wall to the open top; and a substantially rigid cover member having a major portion of a dimension less than the dimension of the open top so that the major portion of the cover member is dimensioned to fit therewithin and having tongues extending diametrically oppositely from opposing edges of the cover member in such a way that the ends of the opposing tongues span a dimension that is greater than the corresponding dimension of the open top, each of said tongues being itself dimensioned to be slidably receivable into corresponding ones of said slots of each of said pairs of confronting slots provided in the side walls.

2. The invention of claim 1, wherein said base member is fabricated from a plastic material.

3. The invention of claim 2, further including two additional confronting side walls joined with said at least two spaced-apart confronting side walls to provide, together with said included bottom wall, an open-top box.

4. The invention of claim 3, wherein said side walls are adhesively joined at the edges of said open-top box.

5. The invention of claim 1, wherein plural pairs of confronting slots are vertically spaced-apart about and along the height dimension of the said at least two spaced-apart confronting side walls.

6. The invention of claim 5, wherein said plural pairs of slots are elongated in a direction perpendicular to the direction along the said at least two spaced-apart confronting side walls along which they are in spaced-apart relation.

7. The invention of claim 1, wherein said cover member is fabricated of a plastic material.

8. The invention of claim 7, wherein said tongues are fabricated of a plastic material and are integral with said cover member major portion.

9. The invention of claim 8, wherein said tongues are in form of flattened blades.

* * * * *